US007312704B1

(12) United States Patent
Powell

(10) Patent No.: US 7,312,704 B1
(45) Date of Patent: Dec. 25, 2007

(54) INTRUSION DETECTION AND SECURE REMOTE ALARM COMMUNICATION FOR A SECURITY SYSTEM FOR THE INACTIVE STORAGE OF THE ACTIVE INGREDIENTS OF WEAPONS OF MASS DESTRUCTION

(76) Inventor: Roger Andrew Powell, 201 W. Maple Ave., Morrisville, PA (US) 19067

( * ) Notice: Subject to any disclaimer, the term of this patent is extended or adjusted under 35 U.S.C. 154(b) by 35 days.

(21) Appl. No.: 11/415,636

(22) Filed: May 2, 2006

Related U.S. Application Data

(62) Division of application No. 10/780,965, filed on Feb. 18, 2004.

(51) Int. Cl.
*G08B 13/00* (2006.01)

(52) U.S. Cl. ..... 340/541; 340/534; 340/5.22; 380/270

(58) Field of Classification Search ..... 340/541–567, 340/5.8–5.86; 380/270–274, 31–34; 713/176–179
See application file for complete search history.

(56) References Cited

U.S. PATENT DOCUMENTS 5,828,317 A * 10/1998 Togashi ..... 340/825.69
6,323,566 B1 * 11/2001 Meier ..... 307/10.2
6,877,097 B2 * 4/2005 Hamid et al. ..... 713/186
6,989,746 B2 * 1/2006 Rasmussen ..... 340/541
2004/0012502 A1 * 1/2004 Rasmussen ..... 340/870.16
2004/0066935 A1 * 4/2004 Marino ..... 380/270
2004/0113778 A1 * 6/2004 Script et al. ..... 340/545.1
2004/0164848 A1 * 8/2004 Hwang et al. ..... 340/5.82

* cited by examiner

*Primary Examiner*—Benjamin C. Lee
*Assistant Examiner*—Jennifer Mehmood

(57) ABSTRACT

A security system to create and maintain a secure communication link between a remote secure storage site and a law enforcement office using a continuous prearranged encrypted signal on the communication link. The authenticity of the encrypted signal is validated at the law enforcement office. Interruption of the encrypted signal is treated as an alarm that must be investigated. Sensors at the remote secure storage site detect intrusions and trigger the transmission of an alarm signal from the site to the law enforcement office on the communication link. The law enforcement office may enable video cameras or containment devices in the event of an intrusion.

8 Claims, 4 Drawing Sheets

INTRUSION DETECTION AND SECURE REMOTE ALARM COMMUNICATION FOR A SECURITY SYSTEM FOR THE INACTIVE STORAGE OF THE ACTIVE INGREDIENTS OF WEAPONS OF MASS DESTRUCTION

CROSS-REFERENCE TO RELATED APPLICATIONS

This Application is a divisional application from original application Ser. No. 10/780,965 filed on Feb. 18, 2004, which is incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION BY REFERENCE OF MATERIAL SUBMITTED ON A COMPACT DISC

Not Applicable

REFERENCE TO A "MICROFICHE APPENDIX"

Not Applicable

BACKGROUND OF THE INVENTION

This invention relates to intrusion detection and secure alarm communication systems that may be used to provide security for weapons creating materials stored in a space.

Recent terrorist acts and analysis have shown that weapons of mass destruction can be created from "active ingredients" that are in inactive storage and are minimally guarded within the United States and the rest of the world. These "active ingredients" of weapons of mass destruction include radioactive materials, chemical materials, and biological materials. An example weapon is the radioactive dispersal device or RDD, otherwise known a dirty bomb. This device is an explosive charge surrounded by non-weapons grade radioactive material that is dispersed in a populated area by detonation of the explosive charge. The explosive charge is readily available, and the "active ingredient", the radioactive material, may be stolen from thousands of minimally guarded storage sites in the world. Similarly, there are numerous sites at which are stored aging chemical weapons such as nerve gas canisters. Therefore, the theft of these "active ingredient" materials by terrorists presents a major risk to the security of the citizens of the United States. Due to the utility of these materials as building blocks for terrorist weapons, these materials require higher levels of security than is presently in place. The risk of a catastrophe increases greatly if any theft of these materials is not immediately detected, thereby allowing the terrorists time to flee and go into hiding to prepare the weapon. Armed guards may be used, but they are an expensive option. Also, armed guards must be constantly present in sufficient force to ensure that they are not overwhelmed before giving an alarm to local law enforcement personnel. Also, armed guards may be compromised by threats or bribery to aid in the theft and the non-reporting of it. Custom designed vaults may be used, but they are also expensive and take a significant time to construct. Ideally, it would be desirable to have an intrusion detection and alarm communication system that is economical and easily and quickly installed at an existing storage location. The security system would maintain a secure communication link to a receiving station manned by sufficient personnel so as to be very nearly incorruptible. The system would announce an alarm at the receiving station, whenever an intrusion was detected or whenever the secure communication link was lost. The receiving station personnel would dispatch rapid response armed personnel to the site to prevent the attempted theft or hotly pursue the thieves until they are captured. The security system would be mass-produceable to minimize costs. Once in place and activated, the system would be constantly active. It would have no means to be turned off without giving an alarm.

A sophisticated intruder team can circumvent existing alarm communication links that transmit an alarm signal from a remote secure site to a receiving station. If the communication link is simple and the secure site only transmits an alarm signal when an intruder is detected, the transmitting mechanism or the communication link only needs to be disabled prior to the intrusion. Then, the alarm signal will not be received and the disabling of the communication link is not immediately detected by the receiving station. If the transmitter at the secure site maintains a constant communication signal on the communication link to demonstrate its integrity, a bogus transmitter operated by the intruder team and interrupting the real transmitter signal prior to the intrusion can replicate the constant signal on the communication link and deceive the receiver. Alternatively, the personnel at the receiving station could be forcibly overwhelmed or compromised by bribery or threats. In any of these scenarios, an intrusion would not be communicated to the outside world for a period of time and that would facilitate the theft and the escape of the intruders. It is advantageous for this time delay to be as short as possible to maximize the probability of successful intervention of the theft and the recovery of the stolen material.

BRIEF SUMMARY OF THE INVENTION

This invention discloses a method and apparatus that overcomes the shortcomings of the existing technology. First, the method provides for maintaining of a secure communication link between a secure storage site and a high security receiver site. Any loss of communication security is immediately detected. It does so by the transmitter at the storage site sending and the receiver at the receiver site receiving a prearranged continuous encrypted signal that cannot be spuriously replicated by an intruder team, thereby continuously demonstrating the integrity of the communication link. If this encrypted signal is interrupted or errors are detected in the encrypted message, the event is treated as an alarm signal and local responders are immediately dispatched to the secure storage site. Further, the invention discloses the use of multiple receivers setting in parallel to detect the encrypted continuous signal and/or any transmitted alarm signal. Therefore, all receivers would have to be compromised by the intruder team to avoid an immediate response by local responders and a widespread alarm. This is a significantly more difficult task for intruders, giving them a much lower probability of a successful theft.

This invention is an electronic system that monitors a secure storage space (at a first location) with sensors and when an intruder enters the space, the sensors detect the intrusion and send an alarm signal to a transmitter within the secured space. When the sensors detect no intruders and the space is secure, which is the normal condition, the transmitter transmits an encrypted continuous data stream signal that indicates this non-intruded condition and this normal signal is received by the receiver at the receiver location (second location) and is verified. This process maintains the communication integrity of the communication link. When the transmitter at the secure storage site receives an alarm signal from a sensor, the transmitter interrupts its normal data stream with an alarm signal. The receiver at the receive location (the second location) receives the alarm signal over the secure communication link and displays an indication of the alarm signal to personnel manning the receiver. Typically, the receiver and its alarm display are located in a high personnel traffic area of the office of an incorruptible local law enforcement authority. If the continuous signal is lost or interrupted as received by the receiver, the receiver will display an alarm at the receiver location, indicating that the communication link integrity has been lost, possibly caused by an intruder team. The continuous signal sent by the transmitter is an encrypted prearranged data stream that is checked and authenticated by the receiver in order to foil attempts by intruders to transmit a false signal to mask an intrusion. The signal cannot be turned off without creating an alarm at the receiver display. If authorized personnel require entry into the space, the opening must be prearranged with and observed by the local authorities, since, during the entry, the alarm signal will still be sent and received by the local authorities. A second receiver can be located at a third location to monitor the communication link and be connected to a State or Federal authority. This provides redundancy to the first receiver and monitoring of the operation of the local law enforcement authority.

When an alarm signal is received by the receiver at the local law enforcement authority station, the operator can turn on a remote video camera at the site to identify the intruders and their strength and dispatch responsive forces. The local law enforcement authority operator may also remotely trigger delaying/containment devices, such as, tear gas or concussion grenades in the secure storage space.

The secure storage space may be an existing storage room in which the active ingredient materials are stored, or the secure space may be enclosed within a sea-going ocean freight container that has been brought to the site for that purpose. These freight containers are modular and readily obtainable. Since the electronic sensors and transmitters would be mass-produced, significant quantities could be produced quickly and economically. If several containers are required for the volume of stored material at a site, they may be interconnected, such that an alarm signal generated by one container will trigger a second signal from a second unit. This interconnecting and interlocking technique would also apply to several storage rooms.

The electronics devices will contain anti-temper features that will protect the secret elements of the devices by means of self-destruct mechanisms. The device may also include redundant devices to increase the validity of detection and increase the time interval for routine service.

One object is to provide a cost-effective method of securing the Active Ingredient of Weapons of Mass Destruction or other dangerous materials from undetected theft. When the theft is immediately recognized the likelihood of recovering the dangerous material and apprehending the perpetrators is greatly increased.

Another object is to always provide the alarm signal directly to local law enforcement personnel, whenever there is an intrusion into the secure storage envelope. The organization and personnel traffic through the local law enforcement office make it significantly more difficult to corrupt or infiltrate then in a local site office manned by a few guards. Another object is to provide an alarm indication to state and/or federal authorities in parallel with the alarm notification to local law enforcement personnel. Another object is to provide a secure data link between the secure storage site and the receiver alarm enunciator in the local law enforcement facility; the loss of the secure data link being a condition that generates an alarm that requires investigation. Another object is to provide a video transmission of the interior and exterior of the secure storage location under alarm conditions and/or at the request of the receiver operator. Another object is to provide the ability to remotely trigger delaying/containment devices at the storage site when an intrusion occurs.

Another object is to provide a security system that can be mass-produced and delivered and installed at an existing storage site in a timely manner using existing infrastructure. Another object is to provide modular secure envelopes surrounding the secure space, such as sea-going shipping containers that are mass-produced and are readily transportable so as to be quickly delivered and easily installed at the storage site. Another object is to provide a security system that does not rely on the integrity of several guards for the instantaneous report of an intrusion. Another object is to provide a security system that has no means to be turned off.

Another object is to provide a security system that uses a primary module overseeing multiple secondary modules method for secure communication and alarm reporting from separate secure envelopes within the secure storage location in order to minimize the cost of the system and reduce communication traffic to the receiver.

DETAILED DESCRIPTION OF THE INVENTION

Figure 1:
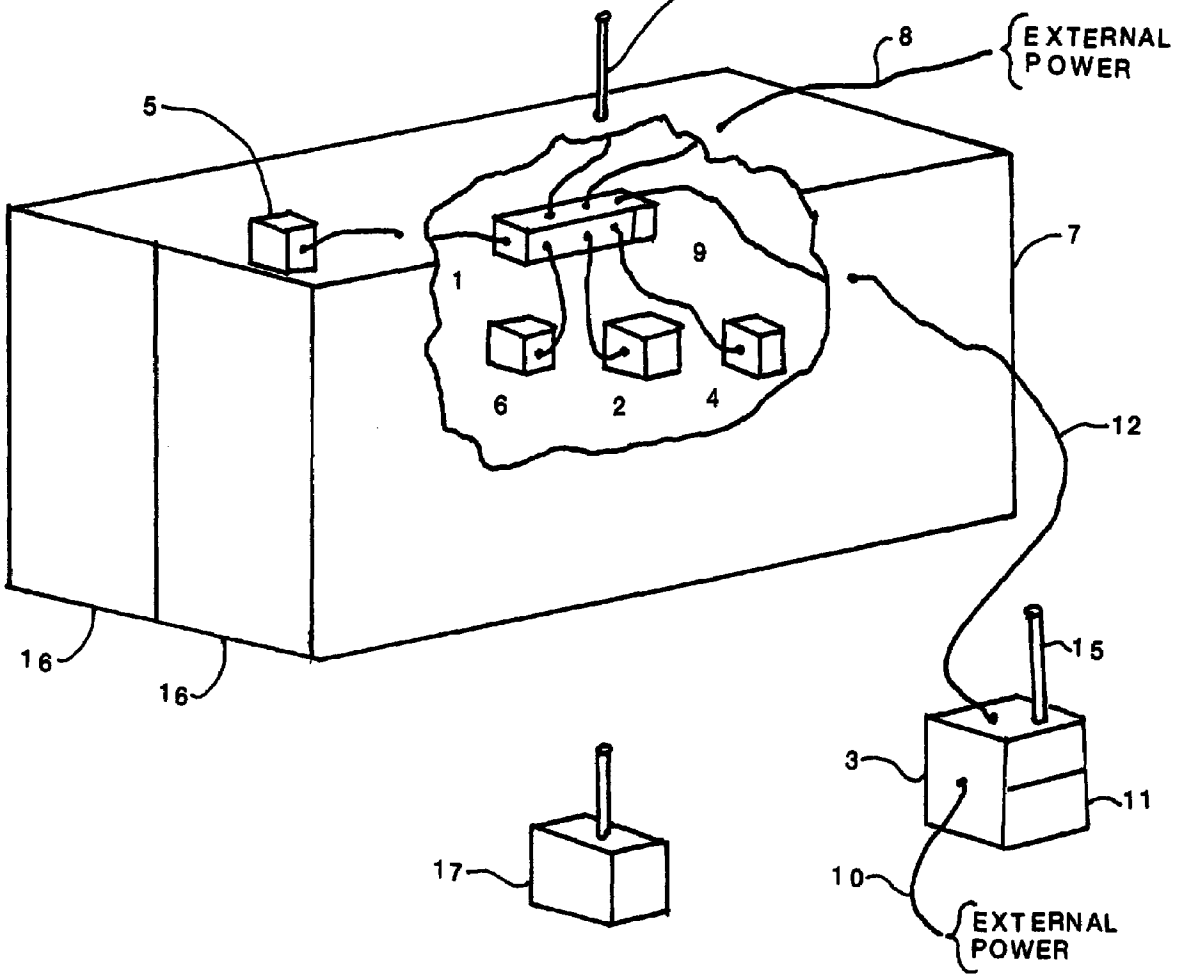
FIG. 1 shows the exterior view of the system using a sea-going container as the secure envelope. A cutaway section shows the interior elements.

FIG. 1 shows the system located at an inactive storage site for active ingredients of weapons of mass destruction. For the purpose of this description, the secure storage location is known as the first location. A seagoing container 7 has been transported to the site by tractor-trailers built for this purpose and that are well known. The container 7 provides an enclosure or physical boundary within which the active ingredients are placed and the container doors 16 are closed and secured. The interior space and/or physical walls of the container are monitored by a sensor module 2 that provides an alarm signal to the transmitter module 1 by means of an interconnecting cable if the space is entered. The sensor module 2 may detect an intrusion into the space using radar detection or by infrared measurement or other means. Multiple sensors using different methods of detection may be used.

The transmitter module 1 is in constant communication with the receiver 3, which is located in another location, known as the second location, where it is constantly monitored by incorruptible personnel, such as in the local law enforcement office. The communication signal content from the transmitter module 1 to the receiver 3 is an encrypted prearranged continuous digital data stream. The receiver 3 is preprogrammed with information so that the receiver 3 can compare the signal from the transmitter module 1 with the preprogrammed information and validate the underlying data stream. Therefore, intruders cannot substitute a false data stream since they would not know the encryption values or the data set. The receiver 3 will recognize any interruption in the transmission of the signal from the transmitter 1 and will indicate/display an alarm condition. The receiver 3 is preferably located in a high personnel traffic area of the local law enforcement authority, so that any alarm is readily observable by a large number of law enforcement personnel. This is called the second location. This second location has a manual alarm button that can be actuated by local personnel in the event of an attack. Actuating this button will cause an alarm signal to be broadcast, thereby creating a widespread alert. The communication link may be by airborne electromagnetic broadcast using an antenna 14 connected to the transmitter 1 at the first location and an antenna 15 connected to the receiver 3 at the second location, or by a landline 12 connecting the transmitter 1 to the receiver 3, or by other means. The continuous encrypted data flow from the transmitter module 1 indicates to the receiver 3 that there are no intrusions detected and that the container 7 is secure. To serve the purpose of this invention, the continuous signal can be at a slow data rate, possibly in the range of one character or word per second. Since this rate is slow, one receiver 3 may be designed to receive and validate multiple data streams from multiple transmitters, thereby reducing the number of receivers required for larger installations. The loss of valid data flow indicates that the communication line is no longer secure, and this is treated as an alarm since this loss may be due to the actions of an intruder team. If this occurs, the receiver 3 immediately sounds/displays an alarm at the second location for the local law enforcement personnel to dispatch local responders to the first location storage site. The alarm announcement may be an audible sound and visual display from the receiver console. For example, if the communication means were disrupted by intruders thereby interrupting the valid data stream signal, the receiver 3 would immediately sound the alarm at its second location. Preferably, the digital encryption method would use a set of encryption values that are set at the transmitter 1 and the receiver 3. These values must be known at both locations to de-encrypt the signal. It would be very difficult to substitute a false data stream signal for the valid data stream signal since the encryption code values and the underlying valid data stream would not be known by intruders and any false substitution would be detected by the receiver 3. The encryption values may be changed periodically by a preprogrammed encrypted message initiated by the receiver 3 or the transmitter 1. A directional antenna may be used on the receiver 3 to make it more difficult for an intruder team to deceive the receiver 3.

If the sensor module 2 detects an intrusion, it sends a signal to the transmitter module 1 via an interconnecting cable, which goes into the alarm mode. The transmitter module 1 sends an alarm signal to the receiver 3 by either electromagnetic broadcast or on a landline 12, over which the normal data stream signal is sent. Simultaneously, the transmitter module 1 may broadcast an open text alarm message on a preselected frequency. The alarm signal identifies the details of the intrusion detection from the sensors in the sensor module 2, since redundant sensors may be used in the sensor module 2, so that a single point failure will not cause a system failure. The transmitter module 1 also activates an internal video module 4 and external video module 5 that activate video cameras to transmit a live video signal to the receiver 3 and also record the video signal at the first location.

The transmitter module 1 can also receive an alarm broadcast from the receiver 3 and thereupon go into the alarm mode. For example, if receiver 3 detects a loss of the encrypted data stream communication, it can sound its local alarm and trigger the transmitter module 1 to go into the alarm mode and begin transmitting live video of the interior and exterior of the storage site and recording the video. The receiver 3 may also broadcast a predetermined alarm signal to other receivers. A second receiver 17 at a third location may monitor the communication link between the transmitter module 1 and the receiver 3. In the event of an alarm signal transmitted by the transmitter module 1 and/or the receiver 3, the receiver 17 will provide an alarm indicator at the third location, which can be linked to other law enforcement authorities or the federal government.

The modules within the container 7 are powered by external electrical power provided through a power cord 8. There are batteries 9 that are charged by the external electrical power, and that provide backup electrical power if there is an interruption in the external power supplied through the power cord 8. In the event of an external power interruption, the transmitter module 1 would detect it and transmit this information to the receiver 3 at the local law enforcement authority. Similarly, the receiver 3 is provided external power through a power cord 10 and would have backup power from storage batteries 11. If the receiver 3 had an interruption in external power, it would broadcast an alarm signal. The receiver housing is protected with anti-tempering sensors so that the receiver 3 cannot be turned off or disabled without producing a local alarm and a broadcast alarm. The receiver 3 is always on. Anti-tampering sensors may be connected to self-destruction components in the receiver 3. The second receiver 17 would have a similar construction and operation as the receiver 3.

Figure 2:
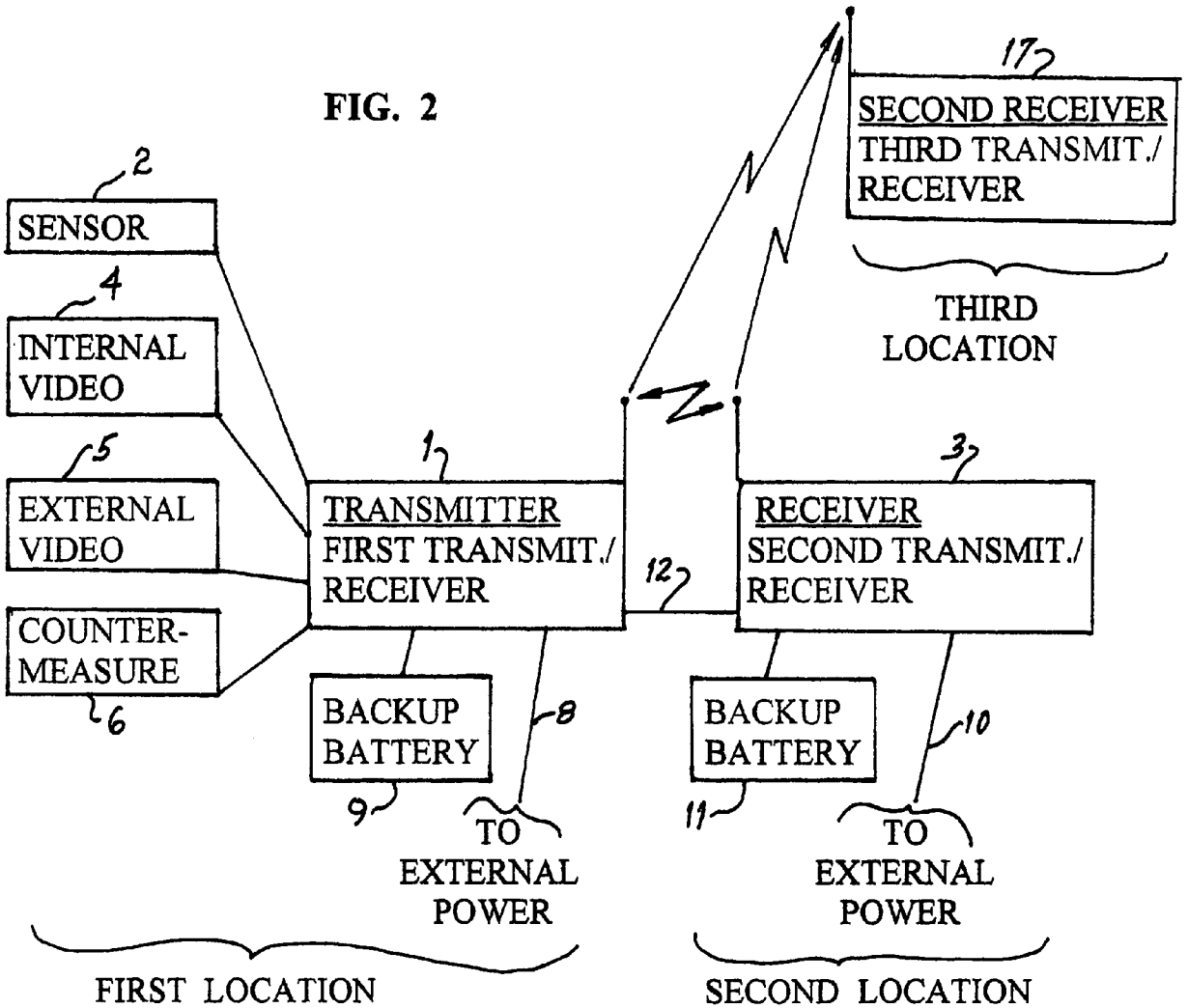
FIG. 2 is a block diagram of the security system.
Figure 3:
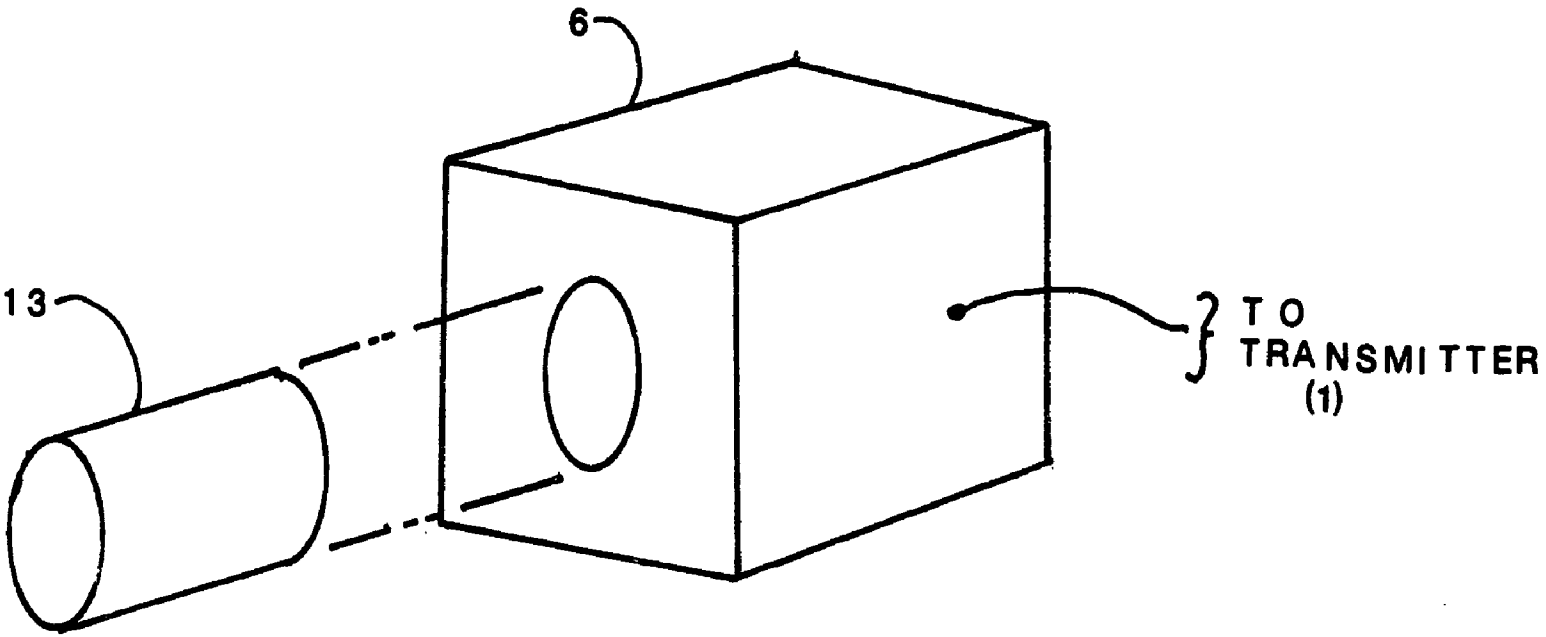
FIG. 3 is a view of the countermeasure device discharging a countermeasure canister.

FIG. 2 is a blank diagram of the system components and their interconnections. The detailed sensor report and live video signals provide important information to the local law enforcement authority on the intrusion to help to determine their response plan. In FIG. 3, inside the container 7 is also a countermeasure module 6 that may contain equipment to delay or debilitate intruders. These may be tear gas canisters 13, or the like. Alternatively, the two components of an expanding foam such as polyurethane may be released onto the active ingredients to fuse them into a mass that is difficult to move and that has to be cut apart. These may be remotely activated by the local law enforcement authority at the location of the receiver 3 that transmits a signal through the transmitter module 1 to the countermeasure module 6.

Figure 4:
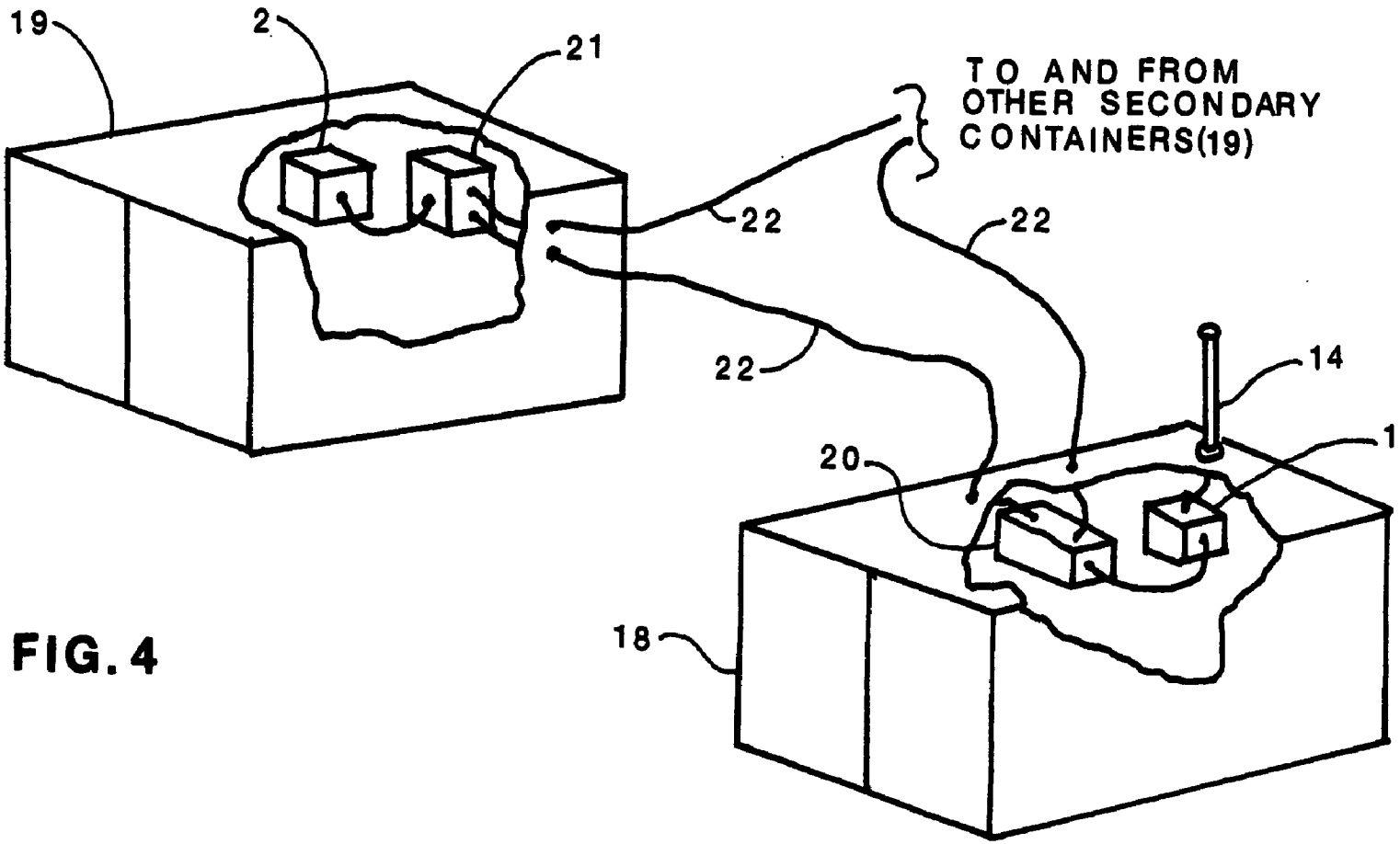
FIG. 4 shows a secondary container and the associated elements. A cutaway section shows interior elements.

If the quantity of active ingredients is large enough to require a number of containers, a prime container 18 and multiple secondary containers 19 may be used. The prime container 18 operates as shown in FIG. 1 but has an additional primary communication module 20 as shown in FIG. 4. The primary communication module 20 is electrically or optically connected to the transmitter module 1 and preferably optically connected to the secondary communication module 21 installed in such secondary container 19 via a fiberoptic cable 22 or the like. The primary communication module 20 produces an electro-optical signal that is input into the fiber optic cable 22 and travels to the secondary communication module 21 in each secondary container 19. The secondary communication module 21 of each secondary container 19 is attached to a sensor module 2 within that container that constantly monitors the secure environment in the secure secondary container 19 and that sends an alarm signal if an intrusion into the secure environment is detected. As long as an intrusion does not occur, the secondary communication module 21 responds to the signal from the primary communication module 20 with a previously programmed answer or reply. This verifies that the fiberoptic communication link 22 is intact and secure. If the fiberoptic cable 22 is cut or interrupted, the primary communication module 20 treats this as an alarm. The use of a fiberoptic cable makes it very difficult for an intruder team to monitor or replicate the transmission on the fiberoptic cable without creating a significant time interruption that would be detected by the primary communication module 20. If a sensor module 2, within a secondary container, senses an intrusion into the secure environment, it transmits an alarm signal through its connection to the secondary communication module 21 that transmits the alarm signal to the primary communication module 20 via the fiber optic cable 22. The primary communication module 20 transmits an alarm signal via an interconnecting cable to the transmitter module 1, whereupon the transmitter 1 transmits an alarm signal to the receiver 3 at the local law enforcement authority as previously described. The data from the sensor module 2 that senses the intrusion is transmitted over this same communication link to the transmitter module 1 and the receiver 3 as previously described. This method in which the primary container 18 is the collection point and transmission point for all secondary containers 19 reduces the number and cost of transmitter units required. There can be multiple primary containers 18 and primary communication modules 20 and transmitters 1, each representing a family of secondary containers 19, for a large field of containers and redundancy arrangements can be established between primary containers 18. Multiple transmitters may take turns transmitting in a rotation over time to a single or multiple receivers 3, or the receiver 3 may poll the transmitters. The secondary containers 19 may also have a live interior video camera 4, a live exterior video camera 5, and video recording that may be broadcast or transmitted over the fiber optic cable 22 or a separate coaxial cable or the like in the event of an alarm as previously described and shown in FIG. 1. The secondary containers 19 may also have countermeasure modules 6 as previously described and shown in FIG. 1. The secondary containers 19 may also have provisions for external power and batteries for backup as previously described and shown in FIG. 1. The fiber optic cable data link between the primary communication module 20 and the secondary communication modules 21 may be in a parallel or serial configuration, and the fiberoptic cable may be replaced with a coaxial or copper conductor cable. The communication link may also be broadcast on a radio frequency.

Similarly, the previously described security system and methodology can be applied to existing buildings and storage rooms or vaults, or to a combination of existing or modified storage rooms, or rooms, buildings, and containers. The sensor modules 2 may be specifically designed and chosen to monitor the particular space in which the materials are stored. The rest of the system may be standardized as previously described, and therefore, mass-produceable.

The intrusion detection sensors 2 must be highly resistant to being deceived and defeated. Typically, the sensor modules are placed within the secure space so that an intruder entering the space to tamper with the sensor modules would be immediately detected as an intruder by one or more sensor modules. Further, several sensors may be arranged to monitor the same space from different locations. Similarly, sensors may be positioned to monitor the location of each other as part of their monitored space. For example, anyone attempting to tamper with one sensor would be detected by another sensor and vice versa.

The communication link between each sensor module 2 and its transmitter 1 must be secure even within the secure envelope, so that if this communication link is interrupted, it will be detected, and it will be treated as an attempted undetected intrusion. One method is to provide power to the sensor module 2 via an electrical conduction wire within an electrical cable that would also include electrical conductor wires for a secure status signal and for an alarm signal. Alternatively, a higher frequency signal could be superimposed on the power conductor wires to send a query or stimulating signal from the transmitter 1 to the sensor module 2 and to which the sensor module 2 would reply with a response signal to the transmitter 1. Also, an infrared optical query signal could be established from the transmitter 1 to the sensor modules 2, to which the sensor modules 2 would reply optically with a unique signature. Alternatively, the transmitter 1 may initiate the exchange optically with an infrared signal and the sensor module 2 response may be by hardwire response, or vice versa.

An alternative method for maintaining the a secure communication link between the transmitter 1 and the receiver 3 over which to transmit the alarm signal could use a first encrypted message sent by the receiver 3 at the local law enforcement authority (at the second location) to the transmitter 1 at the remote storage site (at the first location) that would stimulate a preprogrammed encrypted reply message from the transmitter 1 to the receiver 3. The encrypted message may be the encryption of a character set such as: XWQPT and follow a predetermined format of character type, arrangement, and length. The receiver 3 would then deencrypt the reply and verify the correctness of the response. In further detail, the first message sent by the receiver 3 is an encryption of a first character set taken from a stored list of character sets or from a random number or random character generator. The transmitter 1 determines its response message by deencrypting the first message, performing a preprogrammed internal transformation process using a preprogrammed look-up conversion table or a preprogrammed formula to produce a second character set, encrypting the second character set, and transmitting it. The receiver 3 receives the reply, deencrypts the reply to reveal what is now called the third character set. Also, the receiver 3 performs the same preprogrammed transformation process on the first character set as that preprogrammed in the transmitter 1 to generate a fourth character set and it compares the resulting fourth character set with the third character set received from the transmitter 1. As long as the third and fourth character sets match (are the same, character for character) the communication link is secure and can be relied on to transmit an alarm. If the compared results do not match, the receiver 3 will display a not secure condition and a security breach is possible and must be investigated. Any interruption in the timing of the reply would also initiate an alarm by the receiver 3. The receiver 3 would also broadcast an alarm message. A second receiver 17 at a third location may also be used to monitor this communication link as previously described. The second receiver 17 may have deciphering capability to determine that the first character set satisfies a prearranged format, or it may perform the same function as the receiver 3, or it may simply listen for alarm signals, depending on the level of sophistication desired. This insures that an intruder team has not been overpowered the second location receiver 3 and is substituting a bogus signal for the receiver 3 prior to intruding into the secure storage site. If an intruder is detected at the first location, the transmitter 1 will interrupt its reply message to send an alarm message to the receiver 3 as previously described in the alarm process.

Another variation of this method of does not use the internal transformation of the first character set into a second character set by the transmitter 1. In this case, the receiver 3 at the second location encrypts the original character set taken from a stored list or from a generator using preprogrammed first encryption values and transmits this message to the transmitter 1 at the secure storage site at the first location. The transmitter 1 de-encrypts the message using the preprogrammed first encryption values to reveal the character set. The transmitter 1 then encrypts this character set using a preprogrammed second encryption values to create the reply message and transmits it to the receiver 3. The receiver 3 de-encrypts the reply message using the preprogrammed second encryption value. This resulting deencrypted reply character set must match the original character set to verify the security of the communication link. If the reply character set does not match the original character set, the receiver 3 will display an alarm and broadcast an alarm message. A second receiver 17 at a third location may be used to monitor the communication link as previously described.

In either case, the encryption values may be periodically changed by a preprogrammed encrypted message sent by the transmitter 1 or the receiver 3, so that the messages are more difficult to code-break by a potential intruder. Of course, if an intruder is detected at the first location storage site, the transmitter 1 would transmit an alarm signal as previously described and the receiver 3 would respond by displaying an alarm indication as previously described. The receiver 3 may also broadcast an alarm message.

While the specific embodiments of the invention have been illustrated and described herein, it is realized that many modifications and changes will occur to those skilled in the art. It is therefore to be understood that the appended claims are intended to include all such modifications and changes that fall within the true spirit and scope of the invention.

I claim:

1. A method of establishing and maintaining a secure communication link for transmitting an alarm signal, comprising the steps of:

determining a first character set at a second location, encrypting said first character set at said second location, transmitting said encrypted first character set from said second location, receiving said encrypted first character set at a first location, deencrypting encrypted first character set to reveal first character set at said first location, transforming said first character set to a second character set at said first location using a transformation process known at said second location, encrypting said second character set at said first location, transmitting said encrypted second character set as a reply message from said first location, receiving said reply message at said second location, deencrypting said reply message at said second location to yield a third character set, transforming said first character set at said second location, using the same said transformation process used at said first location, to yield a fourth character set, comparing said third character set to said fourth character set at said second location, providing a display indicating said communication link is secure if said third character set is the same as said fourth character set at said second location, providing a display indicating said communication link is not secure if said third character set is not the same as said fourth character set at said second location.

2. A method for establishing and maintaining a secure communication link for transmitting an alarm signal, according to claim 1, further comprising the steps of:

providing a display indication that said communication link is not secure if there is an unusual delay in receiving said reply message.

3. A method for establishing and maintaining a secure communication link for transmitting an alarm signal, according to claim 1, further comprising the steps of:

interrupting said reply message to transmit an alarm message, transmitting an alarm message from said first location, receiving said alarm message from said first location at said second location, providing a display indication of the alarm condition at said second location.

4. A method for establishing and maintaining a secure communication link for transmitting an alarm signal, according to claim 3, further comprising the steps of:

broadcasting a message that the communication link is not secure from said second location if the communication link is not secure, broadcasting an alarm message from said second location if an alarm message is received from said first location, receiving said alarm message from said first location at a third location and displaying an indication of an alarm condition, receiving said broadcast message that the communication link is not secure from said second location at a third location and displaying an indication that the communication link is not secure, receiving said alarm message from said second location at said third location and displaying an alarm message.

5. A method of establishing and maintaining a secure communication link for transmitting an alarm signal, comprising the steps of:

determining an original character set at a second location, encrypting said original character set at said second location using a first set of encryption values to produce a first message, transmitting said first message from said second location, receiving said first message at a first location, deencrypting first message using said first set of encryption values to reveal said original character set at said first location, encrypting said original character set at said first location using a second set of encryption values to produce a reply message, transmitting said reply message from said first location, receiving said reply message at said second location, deencrypting said reply message at said second location using said second set of encryption values to yield a reply character set, comparing said reply character set to said original character set at said second location, providing a display at said second location indicating a secure communication link if said reply character set is the same as said original character set, providing a display at said second location indicating that communication link is not secure if said reply character set is not the same as said original character set.

6. A method for establishing and maintaining a secure communication link for transmitting an alarm signal, according to claim 5, further comprising the steps of:

providing a display indication that said communication link is not secure if there is an unusual delay in receiving said reply message.

7. A method for establishing and maintaining a secure communication link for transmitting an alarm signal, according to claim 5, further comprising the steps of:

interrupting said reply message to transmit an alarm message, transmitting an alarm message from said first location, receiving said alarm message from said first location at said second location, providing a display indication of the alarm condition at said second location.

8. A method for establishing and maintaining a secure communication link for transmitting an alarm signal, according to claim 7, further comprising the steps of:

broadcasting a message that the communication link is not secure from said second location if the communication link is not secure, broadcasting an alarm message from said second location if an alarm message is received from said first location, receiving said alarm message from said first location at a third location and displaying an indication of an alarm condition, receiving said broadcast message that the communication link is not secure from said second location at a third location and displaying an indication that the communication link is not secure, receiving said alarm message from said second location at said third location and displaying an alarm message.

* * * * *